US006964379B2

(12) United States Patent
Crowley

(10) Patent No.: US 6,964,379 B2
(45) Date of Patent: Nov. 15, 2005

(54) EXTERIOR FIRE SUPPRESSION SYSTEM AND METHOD FOR INSTALLATION

(76) Inventor: Joseph T. Crowley, 423 N. Handy St., Orange, CA (US) 92867

( * ) Notice: Subject to any disclaimer, the term of this patent is extended or adjusted under 35 U.S.C. 154(b) by 128 days.

(21) Appl. No.: 10/409,975

(22) Filed: Apr. 7, 2003

(65) Prior Publication Data

US 2004/0216899 A1 Nov. 4, 2004

(51) Int. Cl.[7] ..... B05B 15/10

(52) U.S. Cl. ..... 239/208; 169/56; 169/16; 169/18; 239/204

(58) Field of Search ..... 239/208, 204, 239/205, 203; 169/48, 49, 56, 16, 18

(56) References Cited

U.S. PATENT DOCUMENTS

| | | | | |
|---|---|---|---|---|
| 1,489 | A | 10/1840 | Lowell | |
| 128,534 | A | 7/1872 | Carl | |
| 647,875 | A | 4/1900 | Piepenbrink | |
| 964,464 | A | 7/1910 | Frost | |
| 1,208,349 | A | 12/1916 | Moody | |
| 1,285,236 | A | 11/1918 | Kohler | |
| 1,507,350 | A | 9/1924 | Franzen | |
| 1,620,142 | A | 3/1927 | Thompson | |
| 1,644,603 | A | 10/1927 | O'Neill | |
| 1,831,880 | A | 11/1931 | Pierce | |
| 1,837,322 | A * | 12/1931 | Hamilton | 239/201 |
| 1,893,210 | A | 1/1933 | Rider | |
| 1,936,732 | A | 11/1933 | Renard | |
| 2,337,710 | A | 12/1943 | Cowan | |
| 2,678,845 | A | 5/1954 | Fitter | |
| 2,757,965 | A | 8/1956 | Andrews | |
| 2,865,674 | A | 12/1958 | Jelmeland | |
| 3,179,181 | A | 4/1965 | Banzato | |
| 3,576,212 | A | 4/1971 | Siler | |
| 3,583,490 | A | 6/1971 | McFadden | |
| 4,091,876 | A | 5/1978 | Valdatta | |
| 4,175,703 | A | 11/1979 | Valiant | |
| 4,330,040 | A | 5/1982 | Ence et al. | |
| 4,372,493 | A | 2/1983 | Smith | |
| 4,428,434 | A | 1/1984 | Gelaude | |
| 4,453,155 | A * | 6/1984 | Cooper | 340/289 |
| 4,824,020 | A | 4/1989 | Harward | |
| 4,836,290 | A * | 6/1989 | Le Lande, Jr. | 169/46 |
| 4,936,388 | A * | 6/1990 | Le Lande, Jr. | 169/46 |
| 4,991,657 | A * | 2/1991 | LeLande, Jr. | 169/46 |
| 5,083,618 | A | 1/1992 | Hayes | |
| 5,125,458 | A * | 6/1992 | Berman | 169/16 |
| 5,165,482 | A | 11/1992 | Smagac et al. | |
| 5,263,543 | A | 11/1993 | Nigro | |
| 5,520,364 | A | 5/1996 | Bloxson et al. | |
| 5,692,571 | A | 12/1997 | Jackson | |
| 5,732,511 | A | 3/1998 | Scott | |

(Continued)

*Primary Examiner*—Christopher Kim
(74) *Attorney, Agent, or Firm*—O'Melveny & Myers LLP

(57) ABSTRACT

An exterior fire suppression system includes a sprinkler system that is connected to a water supply. The sprinkler system is mounted within the structure and is substantially hidden from view when the system is inactive. The system may include roof sprinklers and eave sprinklers that are adapted to saturate the exterior of the structure when the system is activated. Each roof sprinkler is a popup sprinkler installed within a facade that is an aesthetic match with the structure's roof and may be installed within a sprinkler box underneath the roofline. Each eave sprinkler is installed within the eave, substantially hidden from view. A heat sensor may be disposed adjacent to the eave sprinkler and connected to an electronic control to activate the system when excessive heat is detected.

19 Claims, 4 Drawing Sheets

U.S. PATENT DOCUMENTS 6,079,501 A 6/2000 Schmidt
6,109,361 A 8/2000 Henderson
6,131,822 A 10/2000 Farmer, Jr.
6,167,971 B1 * 1/2001 Van Lingen ..... 169/16
6,209,654 B1 4/2001 Curless
6,360,968 B1 3/2002 Orrange et al.
6,406,618 B1 6/2002 O'Leary
6,450,264 B1 9/2002 Christian
6,523,616 B1 * 2/2003 Wallace ..... 169/70
6,629,569 B1 * 10/2003 Adams ..... 169/56
6,679,337 B1 1/2004 Perry et al.
6,741,179 B2 * 5/2004 Young ..... 340/606

* cited by examiner

EXTERIOR FIRE SUPPRESSION SYSTEM AND METHOD FOR INSTALLATION

BACKGROUND OF THE INVENTION

1. Field of the Invention

The present invention relates generally to fire suppression systems and, in particular, to a fire suppression system for protecting a structure from exterior fire threats.

2. Description of the Related Art

Structures, such as houses and office buildings, are sometimes faced with the threat of fire. Many structures are protected from internal fires through an interior fire suppression system, such as an interior sprinkler system. Structures are often left unprotected, however, from exterior fire threats such as radiant heat generated from a fire in a neighboring structure or burning embers that are blown onto the structure from a nearby fire.

When a residential neighborhood is faced with an impending fire, the resources available to local firefighters are limited, and homeowners often take additional measures to protect their houses and yards. For example, a homeowner may climb onto the roof of the house with an ordinary garden hose or lawn sprinkler to fight the impending fire. This approach is usually inadequate to protect the house and dangerous to the homeowner. A typical lawn sprinkler sprays water up into the air to cover a large section of the lawn. The windy conditions that often accompany a wildfire are likely to carry much of the water from a lawn sprinkler away from both the house and yard. A garden hose requires constant operation by the homeowner who must stay on the roof to direct the water towards various sections of house's exterior. While operating the garden hose, the homeowner will often face an impending fire, thick smoke and high winds, which could result in the homeowner being seriously injured or killed from the heat, smoke inhalation or a fall from the roof. In an emergency situation, the homeowner should be focused on personal safety. The use of a lawn sprinkler and garden hose requires constant operation and places the homeowner in greater danger.

Another impediment to the homeowner's use of a garden hose or lawn sprinkler is the reduced availability of water during emergency situations. In many geographical areas, the water pressure available to a structure is reduced during a fire emergency to provide emergency personnel with the water pressure they need to fight the fire.

Prior attempts to create an exterior fire suppression system have proven to be impractical. For example, U.S. Pat. No. 3,576,212, entitled "FIRE-SHIELDING DEVICE," which issued on Apr. 27, 1971, describes a system in which four structures are installed adjacent to each of four exterior walls of a building. Each structure extends from the ground to a height above the roof of the building and includes a pipe that is connected to a water source at the bottom of the structure. At the top of each structure is a pair of sprinkler heads, one designed to spray water in a horizontal direction and another designed to spray water in a high arc to be spread over the roof by the wind.

Another approach is described in U.S. Pat. No. 5,263,543, entitled "EXTERNAL FIRE PREVENTION SYSTEM," which issued on Nov. 23, 1993. In this patent a water pipe is run up the side of the building and connected to another pipe that lies across the top of the roof. The second pipe includes a plurality of sprinklers that are spaced apart. A smoke detector is placed on the side of the building to detect an approaching fire and automatically activate and deactivate the external fire prevention system.

These and other prior art approaches suffer from many drawbacks that have prevented the widespread implementation of exterior fire suppression systems. For example, these systems are not aesthetically pleasing and once installed would be considered an eyesore in many communities. The pipes are exposed to the environment, which can lead to corrosion making the system not only unsightly, but also unreliable. In addition, many homes and other structures are designed with roofs having various shapes and slopes that are not contemplated by these limited systems. Many of the prior art systems also waste water by directing water up into the wind and do not account for the reduced water pressure that is available during a fire emergency.

In view of the drawbacks in the prior art, there is a need for an improved exterior fire suppression system. It would be desirable for the system to be aesthetically pleasing and capable of effectively saturating the structure's exterior using the water pressure that is available to the structure during a fire emergency. It would further be desirable for the system to be easy to operate without endangering the safety of the occupants and firefighters and inexpensive to install or retrofit into existing structures of various sizes and shapes.

SUMMARY OF THE INVENTION

The present invention is an exterior fire suppression system, and method for installation thereof, that overcomes many of the drawbacks found in the prior art systems. In a preferred embodiment, an exterior fire suppression system includes at least one sprinkler that is connected to a water supply of a structure or a secondary water source. The sprinkler is mounted within the structure and is substantially hidden from view when the system is inactive. When activated, the sprinkler saturates a portion of the structure's exterior, providing the structure with protection from external fire threats.

The sprinkler is preferably connected to the structure's water supply through a plumbing system, which includes a gate valve for controlling the flow of water to the sprinkler. The plumbing system may tap into the structure's water supply at any location that provides sufficient water pressure to operate the sprinkler, such as through pipes in an attic or through the main water line on the exterior of the structure. The gate valve preferably includes both mechanical and electrical controls. The gate valve may be located at any point between the water line and the sprinkler, but is preferably installed adjacent to the structure's exterior to provide firefighters and other individuals with access to the fire suppression system.

In a first embodiment, the sprinkler is a roof sprinkler that is adapted to saturate a portion of the roof when the fire suppression system is activated. The roof sprinkler is installed within a facade that aesthetically matches the structure's roof or elements typically found on the structure's roof. For example, the roof sprinkler may be a popup sprinkler that is disguised as a standard roof vent when inactive, and that extends beyond the top of the vent facade when activated to spray water onto a portion of the roof.

In an alternative embodiment, the roof sprinkler is a popup sprinkler installed in a sprinkler box below the roofline. The sprinkler box preferably includes a bottom portion and a top portion. The bottom portion includes a sloped floor having a drain at the bottom thereof and at least one side having a hole adapted for receiving a water pipe. The bottom portion is installed adjacent to the roofline and may be attached to roof beams or other available supports. The roof sprinkler is disposed inside the bottom portion and is connected to the plumbing system of the fire suppression system through the water pipe. In one embodiment, a pressure regulator, a pressure gauge and a shut-off valve are installed inside the bottom portion between the roof sprinkler and the water pipe.

The top portion is adapted to substantially enclose the roof sprinkler inside the sprinkler box. In a preferred embodiment, top portion is a flashing kit that inserts into the bottom portion. The shape of the top portion is adapted to substantially match the shape and angle of the adjacent roofline and, after installation, may be covered with the structure's standard roofing material. In a preferred embodiment, the top portion includes a hole and a cap. The cap plugs the hole when the fire suppression system is inactive, inhibiting water and debris from entering the sprinkler box. When the system is activated, the popup sprinkler forcibly removes the cap and extends through the hole (and a corresponding hole in the roofing material if necessary) to direct water onto the surface of the roof.

The sprinkler box preferably includes at least one access panel, providing access to the interior components of the sprinkler box for installation and maintenance. In one embodiment, the access panel is a lid located on the top portion of the sprinkler box that is accessible under the roofing material. In an alternative embodiment, the access panel is a hinged door on a side of the bottom portion of the sprinkler box that is accessible from the interior of the structure (e.g., an attic).

In a preferred embodiment, the roof sprinkler includes a housing and a sprinkler head assembly. The housing includes an outer pipe having a bottom adapted for connection to the plumbing system and a top that is enclosed by a cap. The cap includes a hole adapted to slidably receive the sprinkler head assembly. The sprinkler head assembly includes an inner pipe that is inserted through the hole in the housing cap such that a first end of the inner pipe is located within the housing and a second end of the inner pipe is located outside of the housing. The first end includes a pair of flanges extending from the outer surface of the inner pipe to the inner surface of the housing. The sprinkler head is attached to the second end of the inner pipe and includes at least one opening adapted to direct water towards a portion of the roof. The roof sprinkler is preferably constructed of a material that provides protection from corrosion, such as stainless steel.

When inactive, the sprinkler head assembly is pulled down through the hole by gravity until the sprinkler head rests on the cap of the housing. When water flows into the housing from the plumbing system, the water pressure against the first flange pushes the sprinkler head assembly upward until the second flange engages the cap. Fully extended, water flows into the first end of the inner pipe, out the second end of the inner pipe and into the sprinkler head, which directs the water flow downward through the openings towards the roof.

In a second embodiment, the sprinkler is an eave sprinkler adapted to saturate a portion of an exterior wall of the structure when activated. The eave sprinkler is installed under an eave of the structure, substantially hidden from view. The eave sprinkler may include a pipe running across the eave having permeations that are adapted to spray water towards an exterior wall of the structure. Alternatively, the eave sprinkler may include a plurality of sprinkler heads to control the spray of the water. The eave sprinkler may be activated by at least one heat sensor that is disposed adjacent to the eave sprinkler and is electrically connected to the automatic gate valve of the plumbing system. The heat sensor is adapted to activate the flow of water through the gate valve when the heat sensor detects a temperature that is higher than a predetermined threshold value.

In one embodiment, the automatic gate valve is connected to an electronic control panel for activating and deactivating the system electronically. The electronic control panel may be a dedicated control panel used only for the exterior fire suppression system or may be connected to other systems in the structure, such as an interior fire suppression system, a security system or a home computer network. In a preferred embodiment, the electronic control panel provides for remote activation of the fire suppression system through a monitoring service, telephone, remote control, computer network or other instrumentality. Heat sensors, smoke detectors or other sensing devices may be connected to the electronic control panel to activate the fire suppression system automatically.

The plumbing system may also include a flow switch, a breather valve and a mixing valve. The flow switch may be adapted to detect the flow of water through the plumbing system and instruct the electronic control panel to produce an audible alarm to warn occupants of an impending fire. The flow switch and electronic control panel may also be adapted to provide the user with notification of a leak in the fire suppression system. The breather valve is installed between the gate valve and the sprinkler, and may be used to drain residual water from the plumbing system when the system is inactive. The mixing valve may be installed to add a mixing agent to the water for better fire suppression qualities. For example, the fire suppression system may be adapted to produce a fire retardant foam or gel.

An installed fire suppression system preferably includes a system of roof sprinklers and eave sprinklers that operate together to completely saturate the exterior of the structure when activated. Roof sprinklers are preferably arranged to provide complete saturation of the roof when the system is activated. Saturation of any given portion of the roof may be achieved directly from a roof sprinkler or indirectly through water runoff from the activated system. For example, the roof sprinklers may be adapted to direct water towards the highest point of a sloped roof, while lower portions of the roof are saturated as the sprayed water flows down the roof. It is contemplated that the eave sprinklers may be controlled through the same plumbing system as the roof sprinklers or may be separately controlled through their own plumbing system.

A more complete understanding of the Exterior Fire Suppression System and Method for Installation will be afforded to those skilled in the art, as well as a realization of additional advantages and objects thereof, by a consideration of the following detailed description of preferred embodiments. Reference will be made to the appended sheets of drawings, which will first be described briefly.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
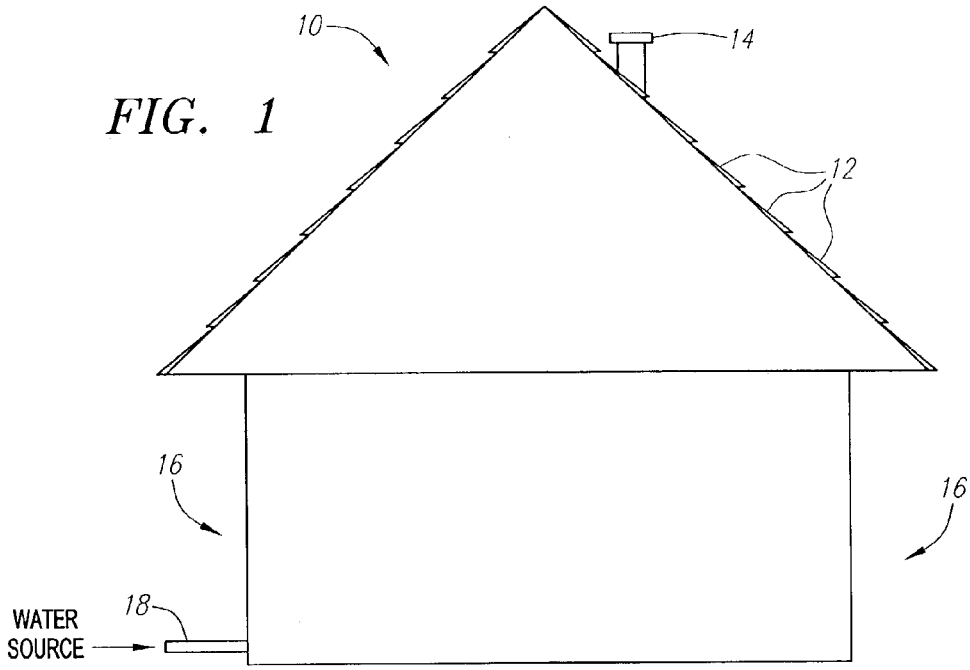
FIG. 1 is a block diagram of a structure's exterior in accordance with a preferred embodiment of the present invention.

A preferred embodiment of the present invention will now be described. Referring to FIG. 1, an exemplary structure equipped with an exterior fire suppression system is illustrated. A house 10 includes common functional and aesthetic exterior features including a roof having a plurality of roofing tiles 12, a roof vent 14 and exterior walls 16. A main water pipe 18 provides water to the house 10 from a pressurized water source such as a public water supply. In alternative embodiments, the water may be pumped into the fire suppression system from a fixed water source (e.g., a pool, pond or storage tank) or a from a mobile water source such as a fire engine. Although a preferred embodiment of the present invention will be described with reference to the house 10, it will be appreciated by those having ordinary skill in the art that the exterior fire suppression system can be installed into other structures having other combinations of functional and aesthetic exterior features. For example, the structure may include any roof design, such as a flat roof or domed roof.

Figure 2:
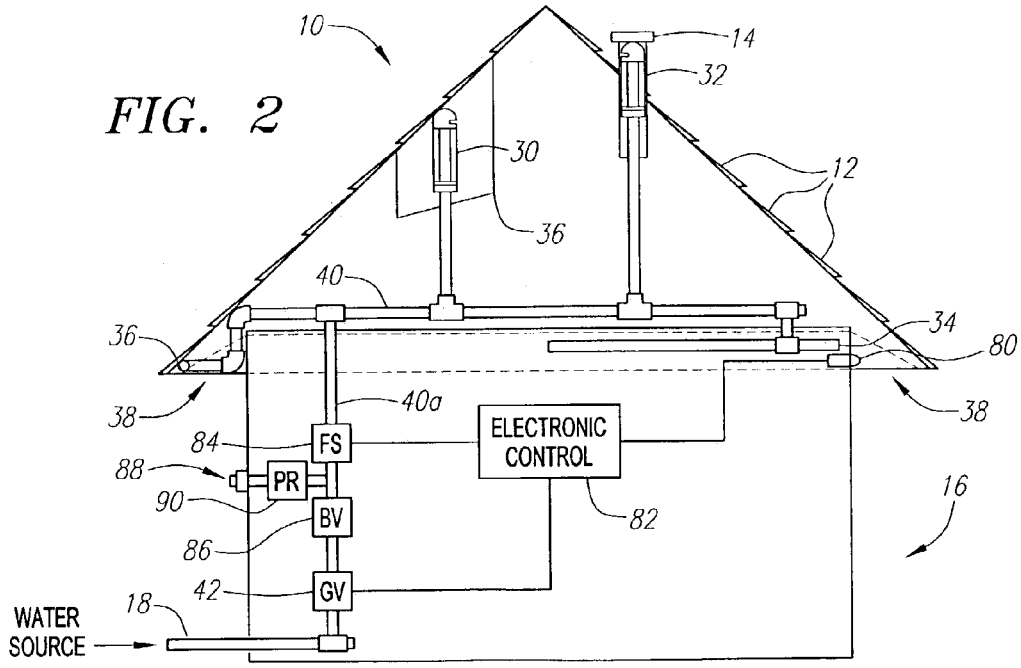
FIG. 2 is a block diagram of an exterior fire suppression system installed in the structure in accordance with a preferred embodiment of the present invention.

A preferred embodiment of an exterior fire suppression system will now be described with reference to FIG. 2. An exterior fire suppression system includes at least one sprinkler, such as roof sprinklers 30 and 32 and eave sprinklers 34 and 36, that is connected to the water supply 18 of the structure 10 through a plumbing system 40. The sprinklers are mounted onto or within the structure 10 and are disguised as standard structural elements, or otherwise substantially hidden from view, when the system is inactive. When activated, each sprinkler saturates a portion of the structure's exterior to protect the structure from external threats of fire and radiant heat.

The plumbing system 40 includes at least one pipe 40*a* and at least one gate valve 42 for controlling the flow of water to the sprinklers. The pipe 40*a* is installed on the interior of the structure between the gate valve 42 and the sprinkler to provide water to the sprinkler when the gate valve is in an "on" position. In a preferred embodiment the plumbing is standard ¾ inch copper piping, but other plumbing may also be used, such as interior pipes commonly used for plumbing or interior fire suppression systems.

The plumbing system 40 may tap into the water supply 18 at any location on the exterior or interior of the structure 10 that provides adequate water pressure to operate the fire suppression system and from which plumbing can be installed and connected to the sprinklers. For example, the plumbing system 40 may tap into the water supply 18 in a garage or attic of the structure 10 or through an interior fire suppression system that is installed in the structure 10. In a preferred embodiment, the fire suppression system is adapted to operate at 30 psi or one half of the water pressure typically supplied to the structure, whichever is greater. In alternative embodiments, the fire suppression system may be adapted to operate at other water pressures depending on the configuration of the fire suppression system, the size of the structure, the material being delivered through the system (e.g., foam or gel) and the level of the threat of fire.

The gate valve 42 may be located at any point between the water supply 18 and the sprinklers 30, 32, 34 and 36, but is preferably installed adjacent to the structure's exterior with a manual control to provide access to the fire suppression system by firefighters and other individuals. Although any type of valve that is capable of controlling the flow of water through the plumbing system 40 may be used, the gate valve 42 preferably includes both mechanical and electrical controls.

Figure 3:
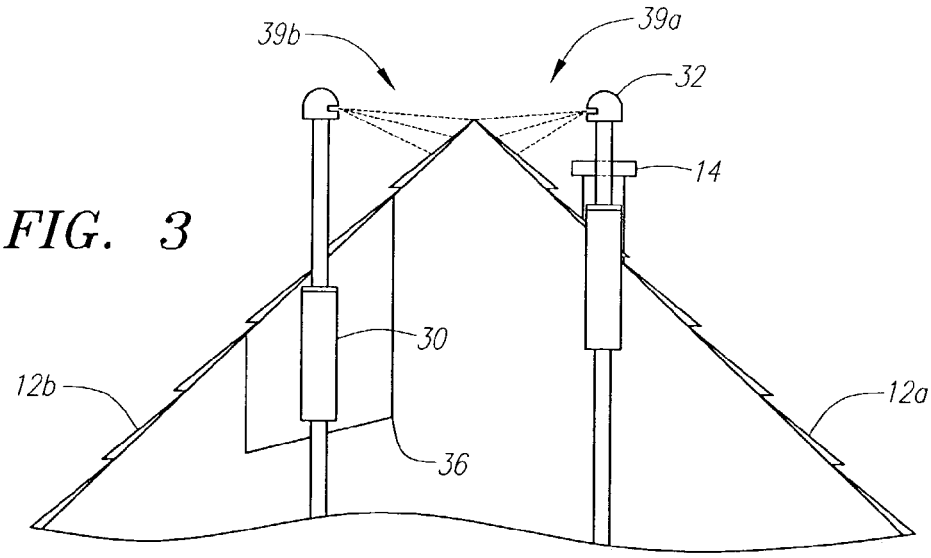
FIG. 3 is a block diagram of activated roof sprinklers in accordance with a preferred embodiment of the present invention.
Figure 4A:
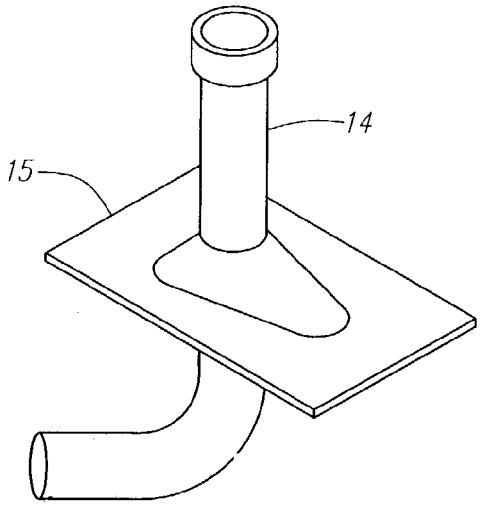
FIGS. 4*a* and 4*b* are block diagrams illustrating an inactive popup sprinkler and a disassembled popup sprinkler, respectively, in a roof vent accordance with a preferred embodiment of the present invention.
Figure 4B:
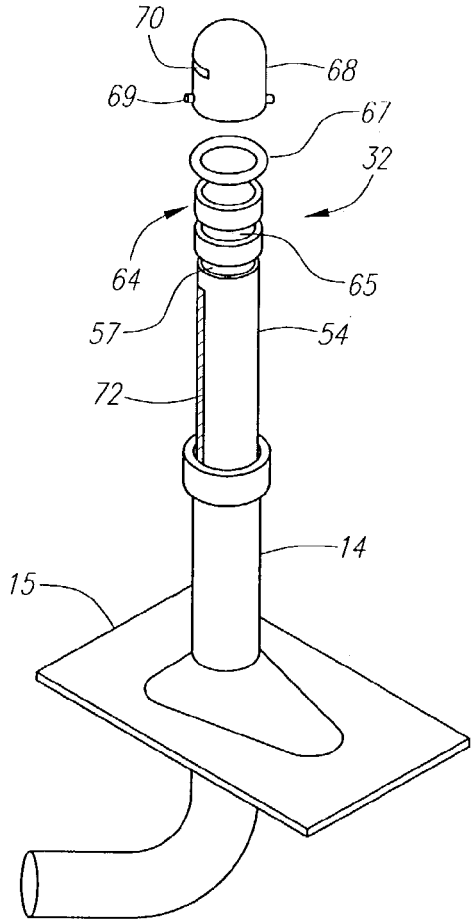

Referring to FIG. 3, each roof sprinkler 30 and 32 is adapted to saturate a portion of the roof 12*a* and 12*b*, respectively, when the system is activated. Each roof sprinkler 30 and 32 is installed within a facade that is an aesthetic match with the roof 12 or elements typically found on a roof of a similar structure. In a first embodiment, the roof sprinkler 32 is a popup sprinkler disguised as a standard plumbing roof vent 14. As illustrated in FIG. 3 and FIGS. 4*a* and 4*b*, the roof sprinkler 32 extends beyond the top of the vent facade 14 when activated to spray water 39*a* onto a portion of the roof 12*a*. The vent facade 14 may be part of a standard vent flashing 15 that is installed into the roof as known in the art. To prevent water from leaking into the interior of the structure through the vent flashing 15 when the sprinkler 32 is activated, the gaps between the sprinkler assembly and the interior of the vent facade are preferably sealed using a caulk.

In a second embodiment, the roof sprinkler 30 is a popup sprinkler installed in a sprinkler box 36 that is located underneath the roof 12. When activated, the roof sprinkler 30 extends beyond the top of the sprinkler box 36 to spray water 39*b* onto a portion of the roof 12*b*. Each roof sprinkler 30 and 32 is preferably adapted to spray water downward towards the roof 12 to reduce the amount of sprayed water that is carried away by the wind. In an alternative embodiment, the roof sprinklers may be adapted to deliver fire retardant foam or gel onto the structure.

Figure 5A:
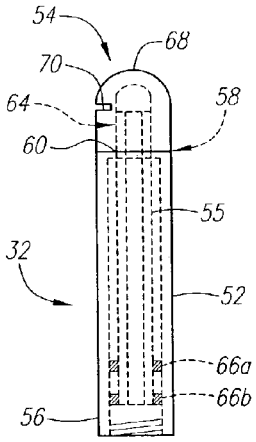
FIGS. 5*a* and 5*b* are block diagrams illustrating an inactive popup sprinkler and activated popup sprinkler, respectively, in accordance with a preferred embodiment of the present invention.
Figure 5B:
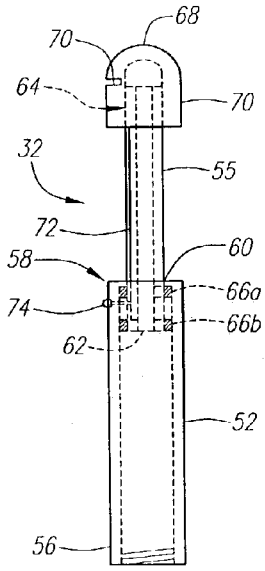

Referring to FIGS. 4*b*, 5*a* and 5*b*, a preferred embodiment of a popup roof sprinkler 32 will now be described. In FIG. 5*a* the popup roof sprinkler 32 is illustrated in an inactive state. In FIG. 5*b*, the popup roof sprinkler 32 is illustrated in an activated state. The roof sprinkler 32 includes a housing 52 and a sprinkler head assembly 54. The housing 52 includes an outer pipe having a first end 56 adapted for connection to the plumbing system and a second end 58 which is capped. In a preferred embodiment, the first end 56 includes threading on the interior of the housing 52 that corresponds with threading on a pipe of the plumbing system. The capped end 58 includes a hole 60 adapted to slidably receive the sprinkler head assembly 54. The sprinkler head assembly 54 includes an inner pipe 55 that is inserted through the hole 60 in the housing 52 such that a first end 62 of the inner pipe 55 is located within the housing 52 and a second end 64 is located outside of the housing 52. In a preferred embodiment, the inner pipe is approximately 12–15 inches in length. The first end 62 includes a pair of flanges 66*a* and 66*b* extending from the outer surface of the inner pipe 55 to the inner surface of the housing 52.

The sprinkler head assembly 54 also includes a sprinkler head 68 having a diameter that is wider than the hole 60 and which is attached to the second end 64 of the inner pipe 55. In a preferred embodiment, the second end 64 of the inner pipe 55 includes a groove 65 around its circumference adapted to receive an O-ring 67, and the sprinkler head 68 includes a corresponding groove (not shown) in its interior surface. The sprinkler head assembly 54 is assembled by pushing the sprinkler head 68 down over the second end 64 of the inner pipe 55, creating a water-tight seal between the O-ring 67, the groove 65 and the interior of the sprinkler head 68. The inner pipe 55 also includes at least one recess 57 for receiving a corresponding screw 69 to secure the sprinkler head 68 to the inner pipe 55 and prevent its rotation. In an alternate embodiment, the sprinkler head and inner pipe include corresponding threading allowing the sprinkler head to be screwed onto the inner pipe.

When inactive (FIG. 5*a*), the sprinkler head assembly 54 is pulled down through the hole 60 and into the housing 52 by gravity until the sprinkler head 68 rests on the second end 58 of the housing 52. When water flows into the housing 52 through the first end 56, the water pressure creates an upward pressure on the flange 66*b* causing the sprinkler head assembly 54 to move upward through the housing 52 until the flange 66*a* engages the capped second end 58 of the housing 52. Fully extended, water continues to flow into the first end 62 of the sprinkler head assembly 54, out the second end 64 and into the sprinkler head 68, which directs the water downward towards the roof through at least one opening 70 in the sprinkler head 68. The spray pattern produced by the sprinkler 50 can be adjusted to form a desired spray pattern by modifying the size, shape and number of openings 70 in the sprinkler head 68. The inner pipe 55 also includes a groove 72 extending across a portion of its length. A screw 74 is inserted through the housing 52 and into the groove 72 to prevent the sprinkler head assembly 54 from rotating during operation. In a preferred embodiment, the roof sprinkler 32 is constructed of a material that provides protection from corrosion, such as stainless steel.

Referring back to FIG. 2, the fire suppression system may also include at least one eave sprinkler 34 and 36 that is adapted to saturate a portion of an exterior wall 16 of the structure 10 when activated. Each eave sprinkler 34 and 36 is installed on the underside of an eave 38, substantially hidden from view. In one embodiment, each eave sprinkler 34 and 36 includes a ⅜ inch (or larger) pipe running parallel to an eave and includes permeations adapted to spray a sheet of water onto the exterior wall 16 of the structure 10 to protect the exterior walls 16 from radiant heat. In alternative embodiments, the eave sprinklers 34 and 36 may include sprinklers directed at the exterior walls 16 or directed downward. Depending on the structure of the eaves, the eave sprinklers 34 and 36 may be visible from directly underneath the eaves 38. To improve the aesthetic appearance, the eaves can be boxed to hide the eave sprinklers 34 and 36 within the eaves.

The eave sprinklers 34 and 36 may be controlled through the same plumbing system as the roof sprinklers 30 and 32 or may be separately controlled through their own plumbing system. In a preferred embodiment, at least one heat sensor 80 is disposed adjacent to an eave sprinkler and is electrically connected to the automatic gate valve 42 of the plumbing system. The heat sensor 80 is adapted to activate the flow of water through the gate valve 42 when the heat sensor 80 detects a temperature that is higher than a predetermined threshold value. The threshold is preferably set above the highest temperature recorded in the geographic area, for example, at 150°. In an alternative embodiment, the eave sprinklers 34 and 36 are connected to the main water pipe through an eave sprinkler plumbing system, independent of the roof sprinkler plumbing system, that includes a gate valve for activating the eave sprinkler independent of the roof sprinklers.

In another embodiment, the automatic gate valve 42 is connected to an electronic control panel 82 for activating and deactivating the system. The electronic control panel 82 may be a dedicated control panel used only for the exterior fire suppression system or may be connected to other systems in the structure, such as an interior fire suppression system, a security system or a home computer network. In a preferred embodiment, the electronic control panel 82 is a keypad connected to a home alarm system that allows the fire suppression system to be activated remotely through a security service, telephone, remote control, computer network or other instrumentality. The heat sensor 80 may activate the fire suppression system directly through the alarm system and the alarm system may also be adapted to sound an audible alarm when the system is activated.

The plumbing system 40 may also include a flow switch 84, a bleeder valve 86 and a mixing valve (not illustrated). The flow switch 84 may be adapted to detect the flow of water through the fire suppression system and signal the alarm system 82 to sound the alarm when the fire suppression system is activated. The flow switch 84 may also be used to detect a leak in the system. The bleeder valve 86 is installed between the gate valve 42 and the sprinklers, and is used to drain residual water from the plumbing system when the system is inactive. In a preferred embodiment, the bleeder valve 86 includes a hose bib for connecting a hose through which the residual water will drain. The mixing valve may be installed to add a mixing agent to the water to increase the fire suppression qualities of the system. For example, the fire suppression system may be adapted to deliver fire resistant foam or gel products. The plumbing system may also include a connection 88 and a pressure regulator 90 for use by local fire personnel.

In a preferred embodiment, an installed fire suppression system includes a plurality of roof sprinklers and eave sprinklers that operate to completely saturate the exterior of the structure when activated. Roof sprinklers are preferably disposed throughout the roof in a manner that provides complete saturation of the roof when the system is activated. Saturation of any given portion of the roof may be achieved directly from a roof sprinkler or indirectly through water runoff from the activated system. At least one roof sprinkler is preferably installed to direct water to the highest point on the roof (see e.g., FIG. 3) allowing gravity to spread the sprayed water across lower portions of the roof. The specific configuration of the sprinklers in the fire suppression system will depend on many factors, including the pitch of the roof, the size of the structure, the type of materials used on the structure and the time in which complete saturation of the structure's exterior should be achieved to adequately protect the structure from an impending fire.

Figure 6A:
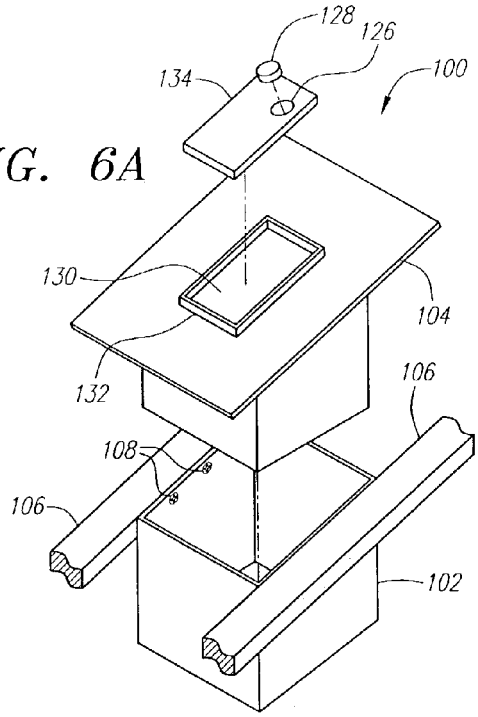
FIGS. 6*a* and 6*b* are block diagrams of a sprinkler box providing a perspective view and side view, respectively, in accordance with a preferred embodiment of the present invention.
Figure 6B:
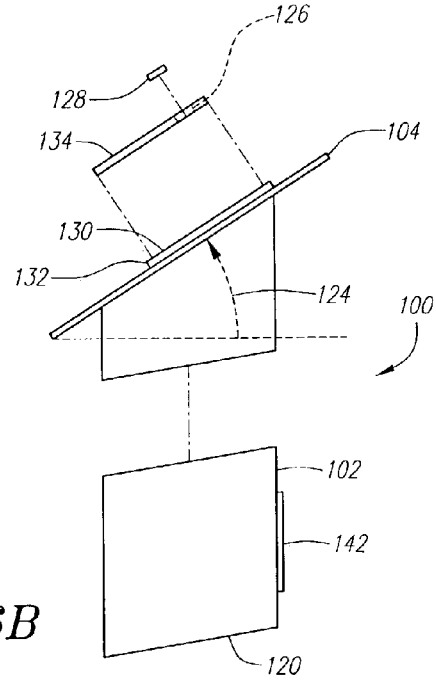
Figure 7:
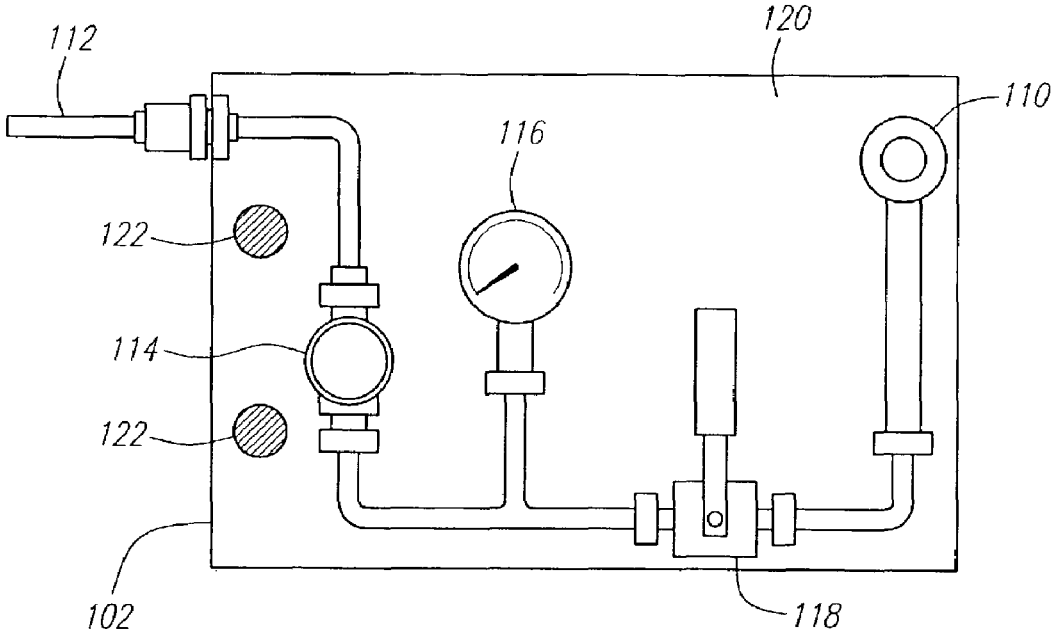
FIG. 7 is a block diagram illustrating a top view of the contents of a sprinkler box in accordance with a preferred embodiment of the present invention.

Referring to FIGS. 6*a* and 6*b*, an embodiment of a sprinkler box 100 will now be described. The sprinkler box 100 includes a bottom portion 102 and a top portion 104. The sprinkler box 100 is preferably constructed from copper; however, it is contemplated that other materials may be used such as sheet metal or plastic. The bottom portion 100 is installed below the roofline of the structure, preferably by attaching the bottom portion 102 to rafters 106 of the structure via a plurality of screws 108. In a preferred embodiment, the bottom portion 102 is adapted to fit between the rafters of an attic of a standard structure and is approximately 14.5 inches long, 12 inches wide and 19–24 inches deep. As illustrated in FIG. 7, the bottom portion 102 is further adapted to house at least one popup sprinkler 110, which is connected to a water supply 112 through a pressure regulator 114, a pressure gauge 116 and a shut-off valve 118. The pressure regulator 114 and pressure gauge 116 are used during installation to adjust the water pressure at the sprinkler box 100 so that the sprinkler 110 operates under sufficient water pressure, such as 30 psi or more. To prevent water from reaching the interior of the structure during operation, the sprinkler box 100 is preferably a liquid-tight box having a sloped floor 120 with at least one drain 122. The drain 122 may be connected to the plumbing of the structure to remove the water that enters the box.

Referring back to FIGS. 6*a* and 6*b*, the top portion 104 of the sprinkler box 100 is preferably a flashing kit that fits inside a previously installed bottom portion 102. The top portion 104 is adapted to substantially enclose the roof sprinkler inside the sprinkler box 100. In a preferred embodiment, top portion 104 is a flashing kit that slidably inserts into the bottom portion 102. The shape of the top portion 104 is adapted to substantially match the shape and angle of the adjacent roofline and, after installation, may be covered with the structure's standard roofing material. In a preferred embodiment, the top portion 104 also includes a hole 126 and a cap 128. The cap 128 plugs the hole 126 when the fire suppression system is inactive, inhibiting water and debris from entering the sprinkler box 100. When the system is activated, the popup sprinkler forcibly removes the cap 128 and extends through the hole 126 (and a corresponding hole in the roofing material) to direct water onto the surface of the roof. The cap 128 may be attached to the sprinkler box 100, such as through a chain or string or via a springed hinge adapted to close the cap 128 into the hole when the system is inactive.

The sprinkler box 100 preferably includes at least one access point that provides a user with access to the contents of the sprinkler box 100 for maintenance or adjustment of the popup sprinkler 110 and associated plumbing. In a preferred embodiment, access to the components of the sprinkler box is provided through a hole 130 cut into the top portion 104. Along the edge of the hole 130 is a lip 132 that is adapted to receive a removable lid 134. In an alternative embodiment, the sprinkler box 100 may include other methods of access, such as an access panel 142 on a side of the bottom portion 102 providing access to the contents of the sprinkler box 100 from inside the attic of the structure.

After installation of the sprinkler box 100, the cover 104 and lid 134 may be covered with the structure's roofing material, such as roof tiles. A hole is cut into the roofing material through which the popup sprinkler 110 extends when activated. The hole may be left open or for aesthetic purposes, plugged with a removable cap that aesthetically matches the roofing material.

Having thus described preferred embodiments of the present invention, it should be apparent to those skilled in the art that certain advantages of the within system have been achieved. For example, most of the components of the exterior fire suppression system described herein are installed in a manner that provides protection from the external environment when the system is inactive, thus reducing corrosion and increasing reliability. It should also be appreciated that various modifications, adaptations, and alternative embodiments thereof may be made within the scope and spirit of the present invention. For example, it is contemplated that various combinations of the embodiments described herein may be merged into one or more systems. It is also contemplated that the fire suppression system can be implemented in any structure in any environment, including city, suburban and rural environments.

The scope of the present invention is defined by the following claims.

What is claimed:

1. A fire suppression system comprising:

a building comprising an interior covered by a roof;

a water supply operatively associated with the building;

a water line connecting a sprinkler head to the water supply via a valve, the water line disposed substantially entirely in the building interior;

a container disposed underneath the roof, the container comprising a lower portion configured to contain a fluid, and an upper portion adapted to substantially enclose the sprinkler head, the upper portion in fluid communication with an exterior of the roof via a hole; and a telescoping mechanism disposed inside the container and interposed between the water line and the sprinkler head, the telescoping mechanism operative to raise the sprinkler head out of the container through the hole when the valve is open, and to retract the sprinkler head into the container when the valve is closed.

2. The fire suppression system of claim 1, wherein the container is configured as a box.

3. The fire suppression system of claim 2, wherein the container box further comprises a removable access panel disposed to provide access to an interior of the box from a location under the roof.

4. The fire suppression system of claim 1, wherein the container further comprises a cap piece disposed to cover the hole when the telescoping mechanism is in a retracted position.

5. The fire suppression system of claim 1, wherein the upper and lower portions of the container are separable, and the upper portion of the container comprises a flange adapted to fit under a covering of the roof as a flashing material.

6. The fire suppression system of claim 5, wherein the upper portion is adapted to substantially match a shape and angle of an adjacent roof portion when installed into the bottom portion.

7. The fire suppression system of claim 1, wherein the lower portion of the container is adapter to direct fluid towards a drain.

8. The fire suppression system of claim 1, further comprising a second water line connecting the water supply to an eave sprinkler mounted adjacent to a building eave, the eave sprinkler being operable to dispense water adjacent to a portion of an exterior wall when activated.

9. The fire suppression system of claim 8, wherein the second water line is substantially contained in an interior portion of the building eave.

10. The fire suppression system of claim 1, further comprising an electronic controller adapted operatively associated with the valve and adapted for operating the valve.

11. The fire suppression system of claim 10, wherein the electronic controller is operatively connected to at least one heat sensor, and the controller is configured to open the valve when the heat sensor detects a temperature that is greater than a predetermined temperature.

12. The fire suppression system of claim 1, wherein the valve comprises a gate valve and the system further comprises:

a breather valve connected to the gate valve, the breather valve adapted for draining water from the fire suppression system when inactive; and a flow switch connected between the breather valve and the sprinkler.

13. The fire suppression system of claim 12, wherein the gate valve is adapted for manual operation via an actuator that is accessible from an exterior of the building.

14. The fire suppression system of claim 12, further comprising an alarm operatively connected to the electronic controller, wherein the flow switch is connected to the electronic controller and is adapted to provide a signal to the controller in response to flow of water through the fire suppression system, and the controller is configured to activate the alarm in response to the signal.

15. The fire suppression system of claim 1, further comprising a mixing valve connected to the water line and adapted for adding a mixing agent to the water.

16. The fire suppression system of claim 1, wherein the water line is further connected to a sprinkler system disposed to dispense water in the building interior.

17. The fire suppression system of claim 1, further comprising a plurality of additional sprinklers each connected to the water line, each of the plurality of additional sprinklers contained in a plurality of corresponding containers disposed under the roof, each of the plurality of corresponding containers comprising a substantially water tight lower portion, and an upper portion adapted to substantially enclose a corresponding one of the plurality of sprinkler heads, the upper portion in fluid communication with an exterior of the roof via a corresponding one of a plurality of holes.

18. The fire suppression system of claim 17, further comprising a plurality of additional telescoping mechanisms each disposed inside one of the plurality of corresponding containers and interposed between the water line and a corresponding one of the plurality of sprinkler heads, each telescoping mechanism operative to raise each corresponding one of the plurality of sprinkler heads out of the corresponding one of the plurality of containers through a corresponding one of the plurality of holes when the valve is open, and to retract the sprinkler head into the corresponding one of the plurality of containers when the valve is closed.

19. The fire suppression system of claim 1, further comprising a pressure regulator connected to the water line and adapted to control water pressure downstream of the valve.

* * * * *